US007984701B2

(12) United States Patent
Re Fiorentin et al.

(10) Patent No.: US 7,984,701 B2
(45) Date of Patent: Jul. 26, 2011

(54) DEVICE FOR CONTROLLING THE MOVEMENT OF A VALVE, IN PARTICULAR OF AN INTAKE VALVE, OF AN INTERNAL COMBUSTION ENGINE

(75) Inventors: Stefano Re Fiorentin, Grugliasco (IT); Mario Palazzetti, Avigliana (IT)

(73) Assignee: Fiat Auto SpA, Turin (IT)

( * ) Notice: Subject to any disclaimer, the term of this patent is extended or adjusted under 35 U.S.C. 154(b) by 210 days.

(21) Appl. No.: 12/279,810

(22) PCT Filed: Feb. 22, 2007

(86) PCT No.: PCT/IB2007/050566

§ 371 (c)(1),
(2), (4) Date: Aug. 18, 2008

(87) PCT Pub. No.: WO2007/096826

PCT Pub. Date: Aug. 30, 2007

(65) Prior Publication Data

US 2009/0013944 A1 Jan. 15, 2009

(30) Foreign Application Priority Data

Feb. 24, 2006 (IT) ..... TO2006A0131

(51) Int. Cl.
*F01L 9/04* (2006.01)

(52) U.S. Cl. ..... 123/90.11; 251/129.01

(58) Field of Classification Search ..... 123/90.11; 335/256; 251/129.01–129.19
See application file for complete search history.

(56) References Cited

U.S. PATENT DOCUMENTS

| | | | | |
|---|---|---|---|---|
| 4,106,466 | A | 8/1978 | Goloff | |
| 4,974,566 | A | 12/1990 | LoRusso et al. | |
| 6,819,208 | B1 | 11/2004 | Peghaire et al. | |
| 2003/0213930 | A1 | 11/2003 | Kreuter | |
| 2005/0188928 | A1 * | 9/2005 | Sedda et al. | 123/90.11 |

FOREIGN PATENT DOCUMENTS

| | | | |
|---|---|---|---|
| DE | 102 07 658 | A1 | 9/2003 |
| FR | 2 792 765 | A1 | 10/2000 |
| JP | 60-98122 | A | 6/1985 |

* cited by examiner

*Primary Examiner* — Zelalem Eshete
(74) *Attorney, Agent, or Firm* — Sughrue Mion, PLLC

(57) ABSTRACT

The device is adapted to control the movement of a valve (1) of an internal combustion engine comprising a stem (1*a*) which may move in translation through an opening (2*a*) of a hollow guide body (2) and which ends in a mushroom head (1*b*) cooperating in operation with a valve seat (12) provided in a wall (13) of the engine head. The valve (1) may move in translation with respect to the hollow guide body (2) between a retracted position and a forward position in which the mushroom head (1*b*) respectively closes and opens the associated valve seat (12).

The control device comprises an electromagnet (3) adapted, when energised, to retain the valve (1) in the retracted closed position, a first spring (7) associated with the valve (1) and tending to urge it towards the open position, and a second spring (8) also associated with the valve (1) and tending to oppose its transition into the open position.

The arrangement is such that when the electromagnet (3) is de-energised, the valve (1) moves in acceleration towards the open position under the action of the first spring (7) until the action of the latter stops, and then the valve (1) moves in deceleration into the open position under the action of the second spring (8).

7 Claims, 2 Drawing Sheets

DEVICE FOR CONTROLLING THE MOVEMENT OF A VALVE, IN PARTICULAR OF AN INTAKE VALVE, OF AN INTERNAL COMBUSTION ENGINE

CROSS REFERENCE TO RELATED APPLICATION

This application is a National Stage of International Application No. PCT/IB2007/050566 filed Feb. 22, 2007, claiming priority based on Italian Patent Application No. TO2006A000131, filed Feb. 24, 2008, the contents of all of which are incorporated herein by reference in their entirety.

The present invention relates to a device for controlling the movement of a valve, in particular of an intake valve, of an internal combustion engine.

The invention relates more particularly to a device for controlling the movement of a valve comprising a stem which is adapted to move in translation through an opening of a hollow guide body and which ends in a mushroom head cooperating in operation with a valve seat provided in a wall of the engine head, wherein the valve is adapted to move in translation with respect to the hollow guide body between a retracted position and a forward position in which the mushroom head respectively closes and opens the associated valve seat.

The object of the present invention is to provide a control device which makes it possible to achieve a substantially constant duration of the period of actual opening of the valve irrespective of the speed of revolution (rpm) of the engine.

In practice, a constant duration of the period of opening of the intake valve makes it possible to achieve different load values by acting on the phasing of this period. When this period straddles the bottom dead centre, where the underpressure in the combustion chamber reaches a maximum, full load conditions are obtained. However, the more the period of opening of the valve, appropriately delayed, is partially in the compression phase, the more partial load conditions are achieved. Opening of the intake valve at the bottom dead centre brings about the so-called "hammer" phenomenon which makes it possible to achieve high volumetric efficiency values (supercharging effect), provided that the duration of opening of the valve is such that its closure is ensured before reflux conditions occur.

This and other objects are achieved by the invention which relates to a control device of the type described above, characterised in that it comprises:

- a stationary electromagnet adapted, when energised, to retain the valve in the retracted closed position,
- first resilient means associated with the valve and tending to urge it towards the open position, and
- second resilient means also associated with the valve and tending to oppose its transition to the open position,
- the arrangement being such that when the electromagnet is de-energised, the valve moves in acceleration towards the open position under the action of the first resilient means until the action of the latter stops, and then the valve moves in deceleration into the open position under the action of the second resilient means.

According to a further characteristic feature, when, in a control device of the invention, the electromagnet is de-energised, the mushroom head, starting from the retracted closed position, may, under the action of the first resilient means, move in translation, substantially in a tight manner or with a limited play, into a recess of the wall of the head facing the combustion chamber until the action exerted on the valve by the first resilient means ceases; the arrangement is then such that when the engine is off the valve is retained by the first and second resilient means in a position of equilibrium in which the mushroom head does not protrude out of this recess into the combustion chamber and is preferably disposed substantially flush with this wall.

As will be explained in further detail below, the control device of the invention may, together with the valve itself, be formed as a self-contained unit which may be inserted in a corresponding seat provided in the engine head.

Further characteristic features and advantages of the invention are set out in the following detailed description, given purely by way of non-limiting example and made with reference to the accompanying drawings, in which:

FIG. 1 is a diagrammatic view in section of an intake valve of an internal combustion engine associated with a control device of the present invention, the valve being in the retracted closed position;

FIG. 2 in a view in section similar to that of FIG. 1, showing the valve and the associated control device of the invention in a condition of equilibrium;

Figure 1:
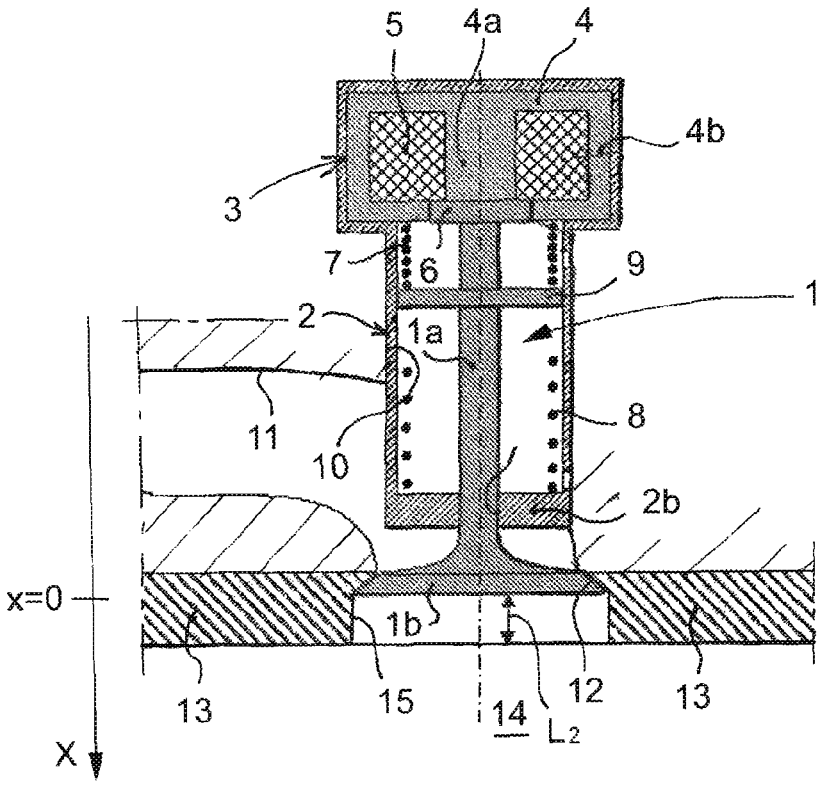
Figure 2:
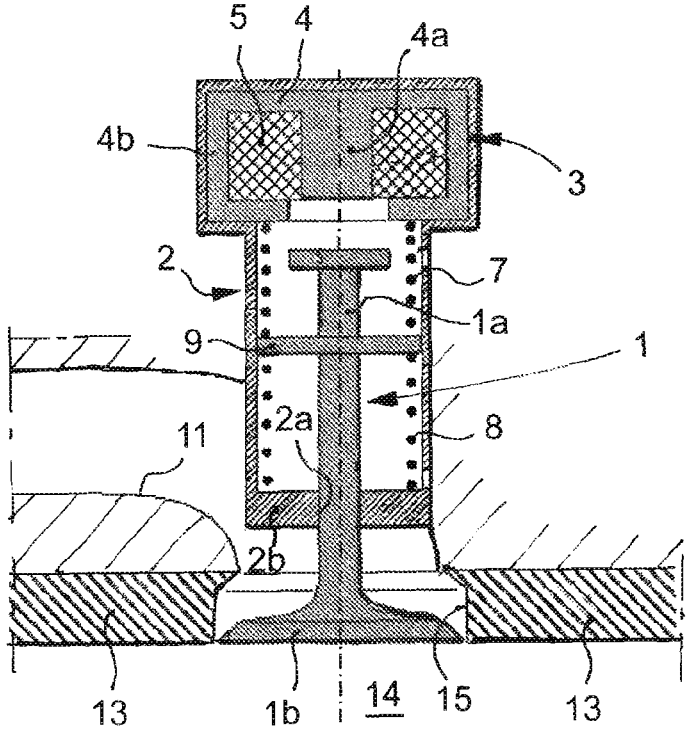
Figure 3:
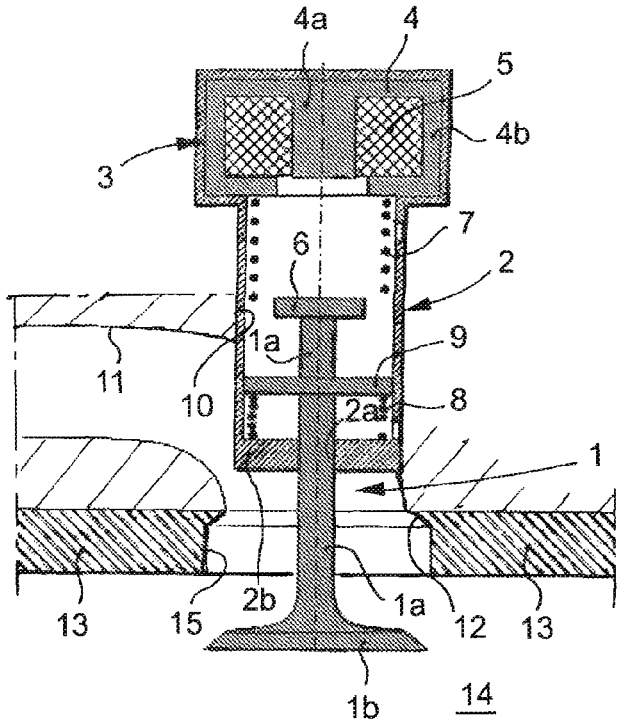
FIG. 3 is a view in section similar to those of the preceding Figures, showing the valve in the open position.

In FIGS. 1 to 3 of the accompanying drawings, a valve of an internal combustion engine, in particular an intake valve, is shown overall by 1.

In a known manner, the valve 1 comprises a stem 1*a* which ends at one end with a mushroom head 1*b*.

The stem 1*a* of the valve 1 is mounted to move in translation through an opening 2*a* in an end wall 2*b* of a hollow support and guide housing shown overall by 2.

On the side oppose the wall 2*b*, an electromagnet shown overall by 3 is housed in the housing 2. In the embodiment shown, this electromagnet comprises a pot-shaped magnetic circuit 4 having a central projection or polar expansion 4*a* surrounded by a substantially cylindrical jacket 4*b*. The excitation winding 5 of this electromagnet is disposed about the projection 4*a* within the jacket 4*b*. The end of the stem 1*a* opposite the mushroom head 1*b* bears a keeper 6 of ferromagnetic material facing the central portion 4*a* of the magnetic circuit 4 of the electromagnet 3.

Two helical springs, shown respectively by 7 and 8, are disposed about the stem 1*a* of the valve 1 in the support and guide body or housing 2.

The upper spring 7 extends between the electromagnet 3 and a plate 9 rigid with an intermediate portion of the stem 1*a* of the valve.

The lower spring 8 extends between the plate 9 and the lower end wall 2*b* of the support and guide housing 2.

The assembly formed by the valve 1, the support and guide housing 2 and the other components described above substantially forms a kind of independent "cartridge", which can therefore be pre-assembled and readily mounted in a corresponding seat 10 provided in the head of the combustion engine, this seat intersecting the end portion of the intake duct 11 with which the valve 1 is associated.

The mushroom head 1*b* of the valve 1 cooperates with a valve seat 12 provided in a wall 13 of the head of the internal combustion engine.

In operation, in the manner described below, the valve 1 may move in translation between a retracted position (FIG. 1) in which the mushroom head (1*b*) closes the valve seat 12 and a forward position (FIG. 3) in which the mushroom head (1*b*) protrudes into the combustion chamber 14, providing the maximum opening.

A recess 15 adjacent to the valve seat 12 is provided on the side of the wall 13 facing the chamber 14. The mushroom head 1*b* of the valve may slide tightly or with a limited play in this recess.

When the winding 5 is energised, the electromagnet 3 attracts the ferromagnetic keeper 6 and retains the valve 1 in the retracted closed position of FIG. 1. In this condition, the upper spring 7 (whose elastic constant will be shown below as $K_1$) is compressed between the plate 9 and the electromagnet 3. The lower spring 8 (whose elastic constant will be shown below as $K_2$) is, however, unloaded.

When the winding 5 of the electromagnet 3 is de-energised, the valve 1 is no longer electromagnetically retained in the retracted closed position, and under the action exerted on it by the upper spring 7, it moves downwards with an accelerating movement until it reaches a position of equilibrium shown in FIG. 2; in this condition, both springs 7 and 8 are substantially unloaded and in equilibrium with one another and the valve 1 is held in a position in which the mushroom head 1*b* again extends within the recess 15 without projecting into the combustion chamber 14, preferably with its lower end surface substantially flush with the lower surface or face of the wall 13. In FIG. 1, the stroke of the valve 1 between the retracted closed position and the position of equilibrium shown in FIG. 2 has an extension $L_2$. This extension $L_2$ is substantially equal to the extent of pre-compression of the spring 7 with the valve 1 closed.

As a result of the presence of the recess 15 of extension $L_2$, the pressure differential between the intake duct 11 and the combustion chamber 14 at the moment at which it is desired to open the valve helps to impart a quantity of movement to this valve 1. Similarly, during the phase of further closing of the valve, when the associated piston of the combustion engine is rising again, the pressure differential (this time of opposite sign) tends to urge the mushroom head 1*b* of the valve 1 into the recess 15, promoting the closure of the valve.

In practice, the mechanical work performed as a result of the above pressure differentials is useful in compensating the energy dissipated as a result of friction forces.

An equation of the movement of the valve 1 during the opening phase will now be described.

When the electromagnet 3 is de-energised, the valve 1 is subject to the concurrent thrusts exerted by the upper spring 7 and by the air pressure in the intake duct 11.

Using an x-coordinate axis oriented downwards (FIG. 1, where x=0 corresponding to the closed position of the valve 1), the force $F_{air}$ which the pressure differential Δp between the intake duct 11 and the combustion chamber 14 exerts on the mushroom 1*b* of the valve may be expressed as a function of the stroke x by the relationship:

$$F_{air}(x)=\Delta p(x).S$$

where S is the exposed surface of the valve.

For simplicity, and as a rough approximation, the following assumptions may be made as regards the pressure differential Δp(x):

during the phase of opening of the valve, as long as the valve is still closed as it is moving in the recess 15, it can be assumed that the pressure differential (positive, i.e. with an underpressure in the chamber 14) is:

$$\Delta p(x) = p_0, \text{ where } x \le L_2 \text{ and } \frac{dx}{dt} > 0$$

during the phase of actual opening ($x>L_2$), it is assumed that Δp(x) is zero:

$$\Delta p(x)=0, \text{ where } x>L_2;$$

during the phase of closure of the valve, when the latter returns to the recess 15, it is assumed that the pressure differential is inverted:

$$\Delta p(x) = -p_0, \text{ where } x \le L_2 \text{ and } \frac{dx}{dt} < 0;$$

The forces of the springs 7 and 8 then act on the valve 1:

Upper spring: this spring exerts a force $$F_1(x)=K_1\cdot(L_2-x) \text{ and } F_2(x)=0, \text{ where } x\leqq L_2$$

Lower spring: this spring exerts a force $$F_2(x)=0 \text{ and } F_2(x)=K_2\cdot(L_2-x), \text{ where } x>L_2.$$

Lastly, the friction forces between the stem 1*a* of the valve and the guide opening 2*a*, and between the plate and the surrounding wall of the support and guide housing 2, also play a part. In relation to these friction forces, it can be assumed that they can be described by a constant term of sign opposite that of the velocity of the valve, as a result of the pressure of the sealing members (present, but not shown in the drawings) and by a term proportional to the modulus of the velocity of opening of the valve 1:

$$F_f = -\left(\frac{a}{|dx/dt|} + b\right)\cdot\frac{dx}{dt}$$

in which aand bare damping coefficients.

This provides the following equation of movement:

$$m\cdot\frac{d^2x}{dt^2} = \Delta p(x)\cdot S + F_1(x) + F_2(x) - \left(\frac{a}{|dx/dt|} + b\right)\cdot\frac{dx}{dt} + m\cdot g$$

On the basis of the equation of movement given above, it is possible to calculate the values of some parameters of the device for controlling the movement of the valve.

Let us assume, for instance, that it is wished to achieve an overall time of actual opening of the valve (i.e. the time during which the mushroom 1*b* is disposed externally to the recess 15) of between 5 and 6 ms.

The following values are assumed for the area and the mass of the valve 1, $$S=7 \text{ cm}^2 \text{ and } m=30 \text{ g}.$$

Reasonable values for the damping coefficients are, for instance, as follows:

$$a=5N \text{ and } b=1{,}5N\cdot s/m$$

On the basis of the above numerical data, a time of actual opening of the order of 5÷6 ms is obtained with the following values of the parameters $L_2$, $K_1$ and $K_2$:

$L_2$=4.0 mm $K_1$=105000 N/m $K_2$=11800 N/m

In order to prevent knock in the closing phase of the valve, which occurs when the work due to the pressure differential exceeds the energy lost by friction, it may be advantageous to provide a pneumatic brake in the last part of the closure stroke of the valve 1, between the magnetic keeper 6 and the electromagnet 3. To this end, provision may be made for the movement of the keeper 6 to take place substantially in a tight manner relative to the polar expansions of the magnetic circuit 4.

Figure 4:
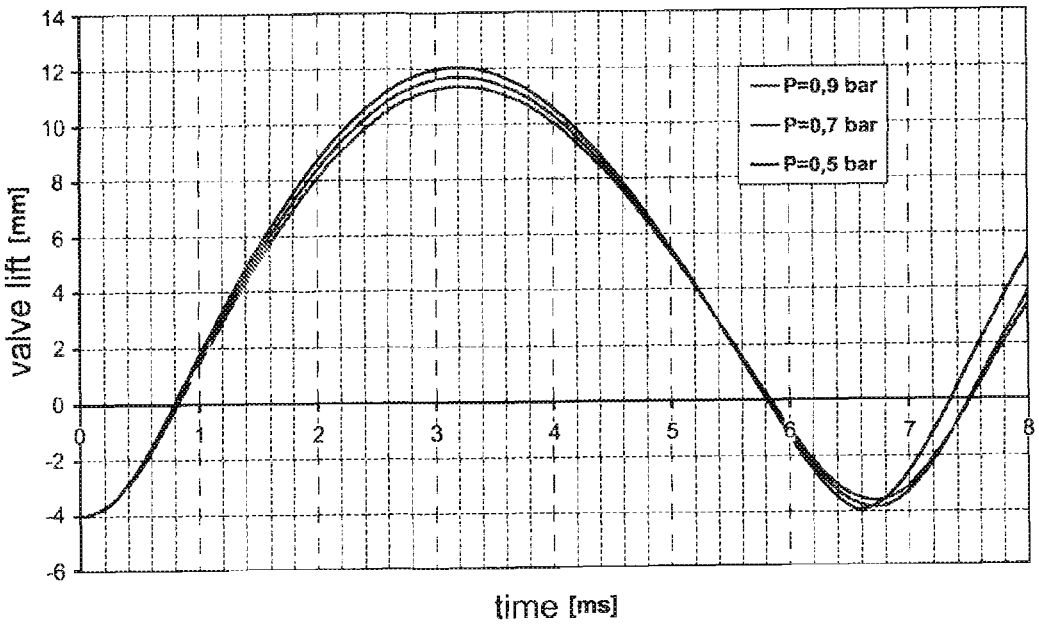
FIG. 4 is a Cartesian diagram showing, as a function of the time shown on the abscissa, the curve of the lift of a valve associated with a device for controlling movement of the present invention.

On the basis of the numerical data given above, the lift profile of the valve 1 as a function of the value assumed for $p_0$ (pressure differential in the phase of movement of the mushroom 1*b* within the recess 15) is shown in FIG. 4.

As can be seen in this Figure, the maximum lift of the valve is equal to 12 mm with an actual opening time of 5 ms.

The values of the retaining force which the electromagnet 3 has to exert for the three values of $p_0$ to which the graphs of FIG. 4 refer are as follows:

$p_0$=0.9 bar: F=483 N $p_0$=0.7 bar: F=469 N $p_0$=0.5 bar: F=455 N

If the magnetic force exerted on the keeper 6 is described by the expression $F=s\cdot B^2/(2\mu_0)$ and if it is assumed that s=3 $cm^2$ (area of the section of the portion 4*a* of the magnetic circuit 4 of the electromagnet), the following value is obtained for the magnetic induction B:

$$B = \sqrt{\frac{2\mu_0 F}{s}}$$

$$= \sqrt{\frac{2\cdot 4\pi\cdot 10^{-7}[N/A^2]\cdot 483[N]}{3.0\cdot 10^{-4}[\mathrm{m}^2]}}$$

$$= 2.0[N/A\cdot m]$$

$$= 2.0[T]$$

In operation, the control device of the valve is initialised when the first compression occurs in the associated cylinder of the engine: the pressure in the combustion chamber 14 causes the full closure of the valve 1 until the keeper 6 is hooked by the energised electromagnet 3.

Associating respective devices for controlling movement of the present invention with the intake valves of an internal combustion engine makes it possible to achieve the opening of these valves in a fixed time, irrespective of the number of revolutions per unit of time of the engine.

The exhaust valves may be traditionally controlled, for instance by a camshaft, or by associated devices for controlling movement of the type described above, obviously driven with a different phasing.

Without prejudice to the principle of the invention, its embodiments and details may obviously be widely varied with respect to what has been described and illustrated purely by way of non-limiting example, without thereby departing from the scope of the invention as set out in the accompanying claims.

The invention claimed is:

1. A device for controlling the movement of an intake valve of an internal combustion engine, comprising a stem configured to move in translation through an opening of a hollow guide body and which ends in a mushroom head cooperating in operation with a valve seat provided in a wall of the engine head, wherein the valve is configured to move in translation with respect to the hollow guide body between a retracted position and a forward position in which the mushroom head respectively closes and opens the associated valve seat, the control device comprising:

an electromagnet having a single polar expansion defining a first end-of-strike position for the valve, corresponding to said retracted closed position; the electromagnet being configured, when energised, to retain the valve in the retracted closed position, first resilient means associated with the valve and tending to urge it from the retracted position towards the forward, open position, and second resilient means also associated with the valve and tending to oppose its transition into the open position, said first and second resilient means being arranged to cause, while the electromagnet is de-energized for a predetermined period of time, a continuous oscillating displacement of the valve away from the retracted, closed position and back towards said retracted, closed position, passing through a second end-of-stroke position.

2. A device according to claim 1, wherein, when the electromagnet is de-energised, the mushroom head, starting from the retracted closed position, may, under the action of the first resilient means, move in translation, substantially in a tight manner or with a limited play, into a recess of the wall of the head facing the combustion chamber with which the valve is associated, until the action exerted on the valve by the first resilient means ceases, the arrangement being such that when the engine is off the valve is retained by the first and second resilient means in a position of equilibrium in which the mushroom head does not protrude from this recess into the combustion chamber and is preferably disposed substantially flush with this wall.

3. A device according to claim 1, wherein the first and second resilient means comprise a respective first and second helical spring disposed about the stem of the valve in the hollow guide body and acting on opposite sides on a transversely projecting formation of the stem of the valve.

4. A device according to-claim 1, wherein a ferromagnetic keeper cooperating with the electromagnet is connected to the end of the stem of the valve opposite the mushroom head.

5. A device according to claim 4, wherein the electromagnet comprises a pot-shaped magnetic circuit having a central projection or expansion facing the keeper and about which an excitation winding is disposed.

6. A device according to claim 4, wherein the keeper may slide in a substantially tight manner into a passage defined in the magnetic circuit of the electromagnet.

7. A device according to claim 1, wherein the guide body forms a housing in which the electromagnet, the valve and the first and second resilient means are pre-assembled in order to form a single overall unit or pre-assembled cartridge.

* * * * *